US005161827A

United States Patent [19]

Grosso

[11] Patent Number: 5,161,827

[45] Date of Patent: * Nov. 10, 1992

[54] INSERT HOLDER WITH SEALABLE OPENING

[75] Inventor: John Grosso, Charlotte, N.C.

[73] Assignee: PCA International, Inc., Matthews, N.C.

[ * ] Notice: The portion of the term of this patent subsequent to Dec. 24, 2008 has been disclaimed.

[21] Appl. No.: 813,104

[22] Filed: Dec. 23, 1991

Related U.S. Application Data

[63] Continuation-in-part of Ser. No. 539,015, Jun. 15, 1990, Pat. No. 5,074,593, which is a continuation-in-part of Ser. No. 445,172, Dec. 4, 1989, abandoned.

[51] Int. Cl.[5] ..... G09F 1/10

[52] U.S. Cl. ..... 283/77; 283/109; 40/158.1; 40/661

[58] Field of Search ..... 283/77, 107, 109, 900, 283/904, 905; 281/15.1; 40/158.1, 661

[56] References Cited

U.S. PATENT DOCUMENTS 4,863,196 9/1989 Ohnishi et al. ..... 283/82

5,074,593 12/1991 Grosso ..... 283/77

*Primary Examiner*—Timothy V. Eley

*Assistant Examiner*—Willmon Fridie, Jr.

*Attorney, Agent, or Firm*—W. Thad Adams, III

[57] ABSTRACT

A transparent insert holder of the type characterized by being adapted to receive and protect cards such as photographs, permits and the like. The insert holder includes first and second four-edged plastic cover sheets for forming front and back surfaces of the insert holder. The first plastic cover sheet has a predetermined-sized transparent window therein defined by a surrounding non-transparent area, and a four-edged, double-sided frame is provided for being positioned between the first and second plastic sheets for securing the first and second sheets to opposing front and back sides of the frame to form the holder. The frame has a pressure sensitive adhesive coating the frame on its front and back surface. The first cover sheet is secured to the frame by the pressure-sensitive adhesive to completely enclose one of the front or back surfaces of the frame. The second cover sheet is secured to the other of the front or back surfaces of the frame along a first edge segment of the frame and unattached to a second edge segment of the frame whereby the second cover sheet is hinged to the frame to form a flap covering the frame which can be flexed away from the frame to insert a card thereunder and into the frame opening. A release liner means covers the adhesive on the second edge segment of the frame covered by the second cover sheet to protect the adhesive until assembly of the frame in the cover sheets.

11 Claims, 3 Drawing Sheets

INSERT HOLDER WITH SEALABLE OPENING

TECHNICAL FIELD AND BACKGROUND OF THE INVENTION

This application is a continuation-in-part of application Ser. No. 539,015, filed on Jun. 15, 1990 now U.S. Pat. No. 5,074,593, which is a continuation-in-part of application Ser. No. 445,172, filed on Dec. 4, 1989 now abandoned.

This invention relates to an insert holder of the type used to enclose small photographs, documents such as drivers licenses, identification cards and the like. Many insert holders are known in the prior art. Those of which the applicant is aware can be categorized as follows:

1. a single transparent or translucent plastic sheet which is folded to receive the insert, after which the folded sheet is laminated to seal the three open sides and laminate the sheets to the opposed faces of the insert;

2. two sheets which are sealed on three sides with a permanently open fourth side so that the insert can be inserted and removed repeatedly.

3. two sheets which are sealed on three sides with a open fourth side so that the insert can be inserted. Then the sheet is laminated to laminate the sheets to the opposed faces of the insert;

4. two sheets which are sealed on three sides with a permanently open fourth side so that the insert can be inserted and removed repeatedly. A number of the holders are attached together by the end opposite the open end, and the assembly is used as, for example, in a wallet to hold credit cards, licenses, and the like.

The present invention is directed specifically towards a holder of the type wherein a photograph, license or the like can be permanently enclosed within the holder without the sheets of the holder being laminated to each other or to the faces of the insert. This avoids the requirement of furnishing a laminating machine and permits the holders to be assembled without any machines and without heat. For these reasons, holders can be furnished to consumers for use at home, and mobile sales locations can be set up in stores without requiring a laminator.

SUMMARY OF THE INVENTION

Therefore, it is an object of the invention to provide an insert holder for permanently enclosing a photograph, license or the like.

It is another object of the invention to provide an insert holder which can be permanently sealed after placing an insert within the holder.

It is another object of the invention to provide a insert holder which can be permanently sealed without the use of a laminating machine or other appliance.

These and other objects of the present invention are achieved in the preferred embodiments disclosed below by providing a transparent insert holder of the type characterized by being adapted to receive and protect photographs, permits and the like.

The insert holder comprises first and second four-sided plastic sheets for forming front and back sides of the insert holder and a four-sided double-sided adhesive frame for being adhesively positioned between the first and second plastic sheet for securing the first and second sheets together in to form the holder. The adhesive frame defines an opening for receiving a photograph therein.

According to one preferred embodiment of the invention, the first and second plastic sheets are separate and the outer perimeter of the adhesive frame is co-extensive with the perimeter of the first and second plastic sheets.

According to another preferred embodiment of the invention, the adhesive frame comprises a base having first and second pressure sensitive adhesive layers applied to respective sides of the base and first and second protective release liners applied to the respective first and second adhesive layers to protect the adhesive.

According to one preferred embodiment of the invention, portions of at least one of the plastic sheets are opaque and define a transparent portion for displaying a photograph therethrough.

According to yet another preferred embodiment of the invention, the first sheet and the second sheet each have a slot or hole therein for receiving a holding strap or strand therethrough.

According to one preferred embodiment of the invention, the slots in the first and second sheets are in registration with each other.

According to one preferred embodiment of the invention, the insert holder includes first and second four-edged plastic cover sheets for forming front and back surfaces of the insert holder. The first plastic cover sheet has a predetermined-sized transparent window therein defined by a surrounding non-transparent area, and a four-edged, double-sided frame is provided for being positioned between the first and second plastic sheets for securing the first and second sheets to opposing front and back sides of the frame to form the holder. The frame defines a frame opening for receiving a like-sized card therein. The frame opening is larger than the transparent window in the cover sheet to mask the joint line between the card and the frame opening.

The thickness of the frame is approximately the same thickness as the card to be inserted in the frame opening whereby the frame forms a support for the card to keep the card in proper alignment while assembly of the holder is completed. The frame and the card inserted in the frame opening together define substantially uniform and flat opposing front and back insert holder surfaces.

The frame has a pressure sensitive adhesive coating the frame on its front and back surface. The first cover sheet is secured to the frame by the pressure-sensitive adhesive to completely enclose one of the front or back surfaces of the frame.

The second cover sheet is secured to the other of the front or back surfaces of the frame along a first edge segment of the frame and unattached to a second edge segment of the frame whereby the second cover sheet is hinged to the frame to form a flap covering the frame which can be flexed away from the frame to insert a card thereunder and into the frame opening.

A release liner means covers the adhesive on the second edge segment of the frame covered by the second cover sheet to protect the adhesive until assembly of the frame in the cover sheets.

According to another preferred embodiment of the invention, the first and second plastic sheets are separate and the outer perimeter of the adhesive frame is substantially co-extensive with the perimeter of the first and second plastic sheets.

According to yet another preferred embodiment of the invention, the release liner means comprises a first, U-shaped segment for being applied over the adhesive covering the second edge segment of the frame and a second, straight segment for being applied co-extensive with the fourth side of the same on of the first and second plastic sheets.

According to one preferred embodiment of the invention, the frame includes first and second openings for receiving respective cards.

According to another preferred embodiment of the invention, the surrounding non-transparent area of the first cover is opaque.

According to yet another preferred embodiment of the invention, the surrounding non-transparent area of the first cover is printed to provide an opaque decorative border.

According to yet another preferred embodiment of the invention, the holder includes a magnetic data strip applied to one of the cover sheets.

An embodiment of the method of forming an insert holder of the type characterized by being adapted to receive and protect an object such as a card bearing a photograph or permit for display to an intermediate assembly configuration according to the invention comprises the steps of providing first and second plastic cove sheets for forming front and back surfaces of the insert holder, and providing a frame having adhesive on opposing first and second surfaces for being adhesively positioned between the first and second plastic sheets for securing the first and second sheets together in to form the holder, the frame defining at least one opening for receiving a card therein. The frame is secured by one of its first or second surfaces to one of the cover sheets. The second cover sheet is secured to the other of the front or back surfaces of the frame along a first edge segment of the frame and leaving the remainder of the cover sheet unattached to a second edge segment of the frame whereby the second cover sheet is hinged to the frame to form a flap covering the frame which can be flexed away from the frame to insert a card thereunder and into the frame opening.

According to one preferred embodiment of the invention, the method includes the step of inserting the card into the frame, and securing the cover sheet and frame along the second edge segment together after the card is inserted.

According to another preferred embodiment of the invention, the method includes the step of providing a release liner covering and protecting the adhesive along the second edge segment until after the card has been inserted into the frame and attachment of the second cove sheet and frame along the second edge segment is desired.

According to yet another preferred embodiment of the invention, the method includes the step of providing a magnetic data strip applied to one of the cover sheets.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 2:
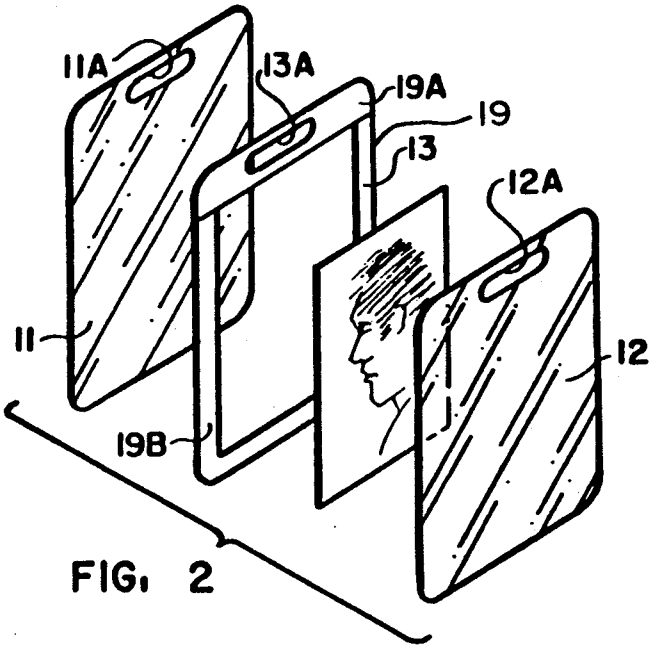
FIG. 2 is an exploded view of the insert holder shown in FIG. 1.
Figure 1:
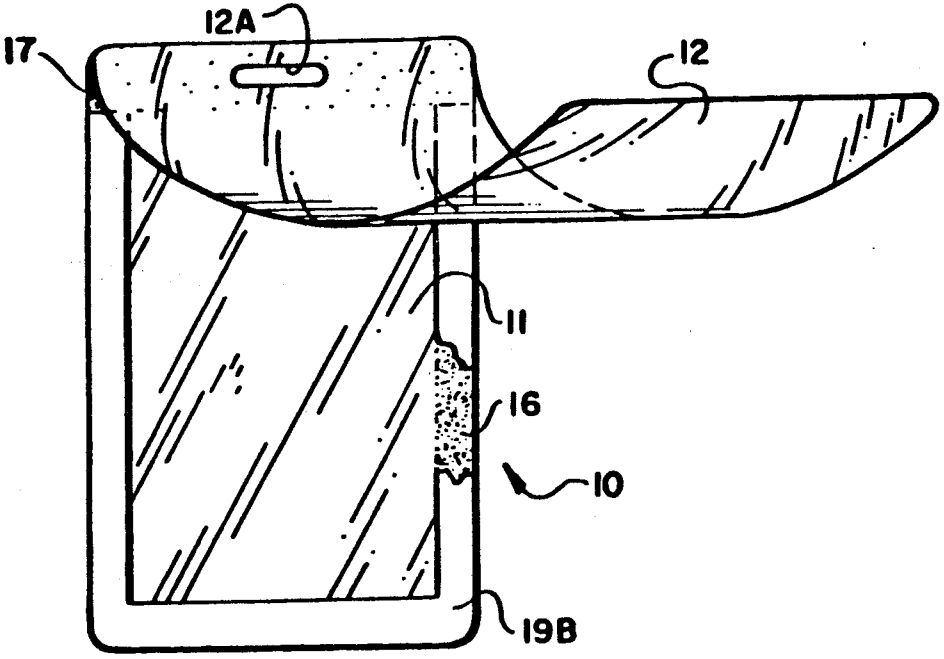
FIG. 1 is a perspective view of an insert holder according to one embodiment of the invention in a state of partial assembly.

Referring now specifically to the drawings, an insert holder according to the present invention is illustrated in FIGS. 1 and 2, and shown generally at reference numeral 10. Holder 10 is formed of a plastic sheet 11, a plastic sheet 12 and an adhesive frame 13. Sheets and 12 and frame 13 all have the same dimensions and are preferably provided with slots 11A, 12A and 13A, respectively, to receive a holding strap after assembly.

The adhesive frame 13 is assembled of a thin plastic or paper substrate sheet having pressure sensitive adhesive layers applied to opposite sides. The adhesive layers are protected by release liners until adhesive frame 13 is used. Release liner 19 is scored to provide individually removable segments 19A and 19B.

Insert holder 10 is assembled by first removing a release liner from the back side of frame 13. This exposes an adhesive layer 16 (see FIG. 1), and the frame 13 is then adhered to plastic sheet 11. Next, release liner segment 19A is removed to expose a strip of the adhesive layer 17 across the top of frame 13.

Sheet 12 is placed in registration over frame 13 and the top edge of sheet 12 is pressed against the exposed adhesive 17, thereby securing sheet 12 and frame 13 together across the top edges. This is shown in FIG. 1.

At this stage, the remaining assembly may be deferred for as long as desired, usually until the insert is ready to place between the sheets 11 and 12. The frame 13 has a thickness which, when applied to sheet 11, forms a template within which a photograph or other card may be placed. By insuring that the insert is no larger than, and preferably slightly smaller than, the open space inside frame 13, the insert can be quickly and accurately placed between the sheets 11 and 12, so that the insert is perfectly aligned with the side edges of the sheets 11 and 12.

Then, the remaining frame segment 19B is peeled away from the adhesive layer 17, and sheet 12 is pressed against adhesive layer 17 around the remaining periphery, sealing the insert permanently inside the holder 10.

Holder 10 may be any suitable size. A preferred embodiment provides a holder which is 2.38 inches wide and 3.5 inches long. Frame segment 19A is 0.375 inches wide. Frame segment 19B is 0.25 inches wide. Slots 11A, 12A, 13A are each 0.13 inches wide and 0.56 inches long.

Sheet 11 is 0.035 inch thick clear plastic. Sheet 12, which serves as the display side of the holder 10 is 0.040 inch thick. Frame 13 is preferably opaque to form the appearance of a frame or border when applied as described above.

Figure 3:
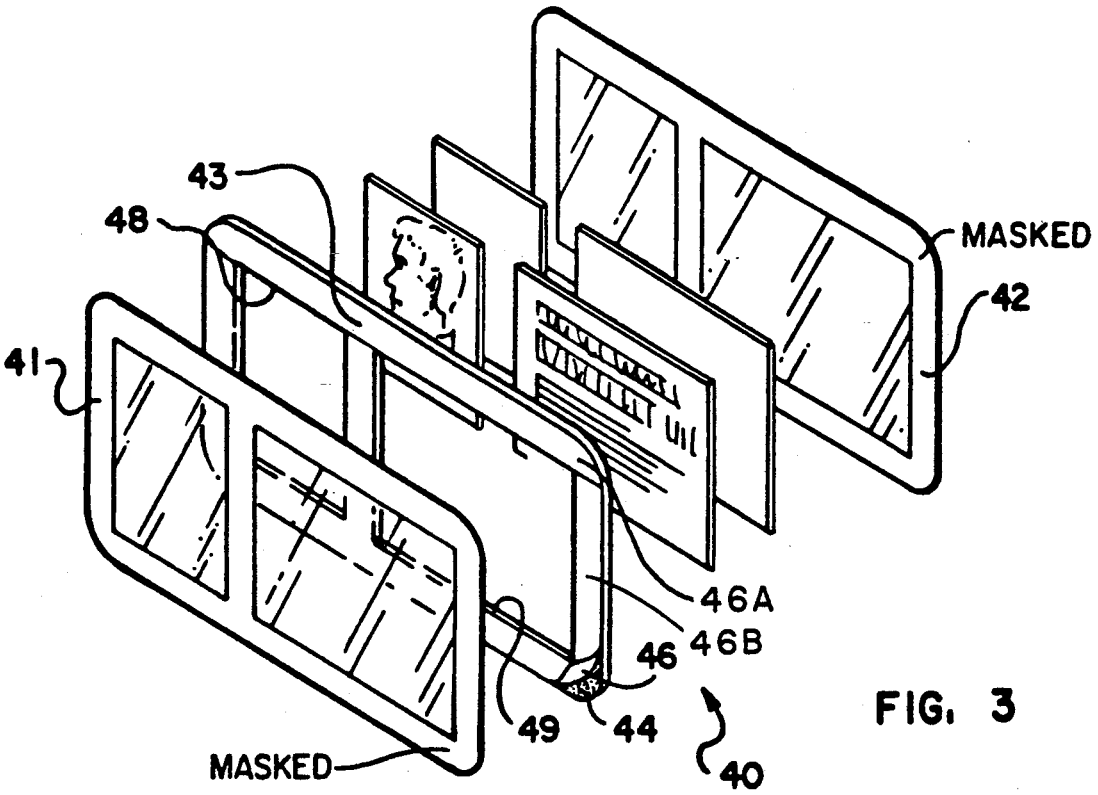
FIG. 3 is an exploded view of another embodiment of the invention.

A further embodiment of the holder according to the invention is shown in FIG. 3 and broadly indicate at reference numeral 40. Holder 40 is formed of a plastic sheet 41, a plastic sheet 42 and an adhesive frame 43. Sheets 41 and 42 and frame 43 all have substantially the same dimensions and are may be provided with slots or holes (not shown) to receive a holding strap, chain or the like after assembly in the manner described above.

Sheets 41 and 42 may be silk-screened or otherwise printed to provide opaque, darkened or decorative border areas leaving centrally-disposed transparent areas to display underlying photographs, identification cards or the like.

The adhesive frame 43 is assembled of a thin plastic or paper substrate sheet having pressure sensitive adhesive layers applied to opposite sides. At least the adhesive layer on one side of the frame 43 is protected by a release liner 46 (shown with a corner folded down) until adhesive frame 43 is used. Then the release liner 46 is peeled off to expose the adhesive.

The frame 43 has two die-cut openings 48, 49 to receive photographs, identification cards or the like.

As is shown in FIG. 3, two photographs or identification cards can be placed back-to-back and then placed in the openings 48, 49. The thickness of the frame 43 is sufficient to hold the inserts in their proper position until the sheets 41 and 42 are adhered to opposite sides of frame 43.

Sheets 41 and 42 may be the same or different thicknesses, for example 0.01" for front sheet 41 and 0.02" for back sheet 42. This provides proper rigidity to the assembled holder. Frame 43, including the adhesive layers, is preferably 0.016" thick. The dimensions of the sheets 41 and 42 and frame 43 are 3.375" by 2.125". Preferably the openings 48, 49 are very slightly larger in dimension than the transparent areas of sheets 41, 42 to provide a neat finished appearance.

The holder 40 may be assembled to a partial stage of completion in an initial assembly process by a manufacturer and shipped to a photographic studio or directly to the consumer for final assembly after inserting photographs, identity cards or the like into die-cut openings 48, 49. In the embodiment shown in FIG. 3, release liner 46 includes two release liner segments 46A and 46B. After attaching the sheet 42 to frame 4 the release liner segment 46A is removed and the top edge only of the sheet 4 is secured to the adhesive exposed on the top of the frame 43. The sheet 41 is sufficiently flexible to allow the sheet 41 to be flexed upwardly away from the surface of frame 43 to a degree adequate to permit the photographs or identification cards to be slipped into the openings 48, 49. This partial stage of assembly is shown in FIG. 4.

Final assembly is then accomplished by removing the release liner 46B and pressing the sheet 41 against the newly-exposed adhesive on the face of frame 43.

Figure 4:
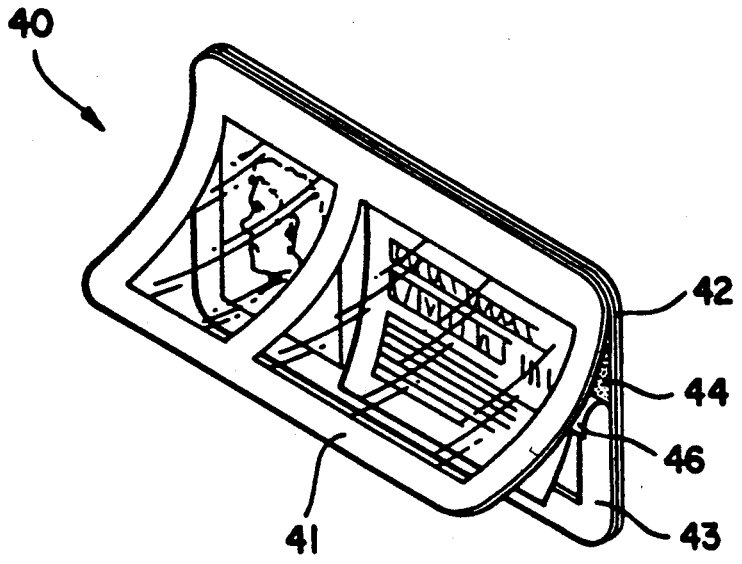
FIG. 4 is a perspective view of an insert holder according to the embodiment of the invention illustrated in FIG. 3.
Figure 5:
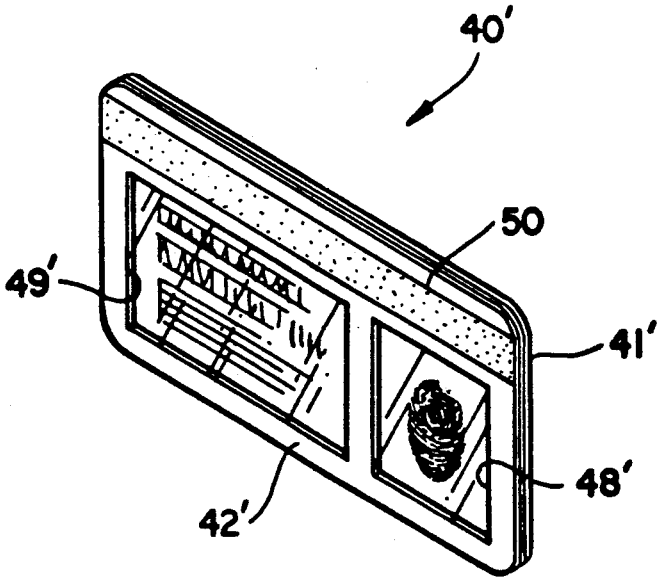
FIG. 5 is a perspective view of the insert holder according to yet another embodiment of the invention, including a magnetic data strip.

As is shown in FIG. 5, an insert holder 40' is illustrated, with prime reference numerals designating elements structurally analogous to the insert holder 40 shown in FIGS. 3 and 4. A magnetic data strip 50 is placed on the sheet 41 or 42 in a suitable location. In FIG. 5 the data strip 50 is shown on sheet 42', and is positioned longitudinally along sheet 42' near one edge. Of course the data strip 50 can also be placed in other positions on either sheet 41' or 42' depending on the size and shape of the other material which must be visible on the holder 40'. The provision of the magnetic data strip 50 enables a holder to contain both highly personalized information such as photographs and fingerprints, as well as a substantial amount of information in digital form on the data strip 50. Thus the issuer of the holder with the magnetic strip 50 can much more easily control use of the card by use of both visual comparison of the individual in possession of the card with the photograph on the card, and identification of the card by magnetic means through magnetic data readers.

An insert holder and method of construction of an insert holder according to several embodiments of the invention is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An insert holder for receiving, protecting and displaying an object such as a card bearing a photograph or permit inserted therein, and comprising:

(a) first and second four-edged plastic cover sheets for forming front and back surfaces of the insert holder, the first plastic cover sheet having a predetermined-sized transparent window therein defined by a surrounding non-transparent area;

(b) a four-edged, double-sided frame for being positioned between the first and second plastic sheets for securing the first and second sheets to opposing front and back sides of the frame to form the holder, the frame defining a frame opening therein for receiving a like-sized card therein, the frame opening being larger than the transparent window in the cover sheet to mask the joint line between the card and the frame opening, the thickness of the frame being the same thickness as the card to be inserted in the frame opening whereby the frame forms a support for the card to keep the card in proper alignment while assembly of the holder is completed and the frame and the card inserted in the frame opening together define substantially uniform and flat opposing front and back insert holder surfaces;

(c) said frame having a pressure sensitive adhesive coating the frame on its front and back surface;

(d) said first cover sheet being secured to said frame by said pressure-sensitive adhesive to completely enclose one of the front or back surfaces of the frame;

(e) said second cover sheet being secured to the other of the front or back surfaces of the frame along a first edge segment of the frame and unattached to a second edge segment of the frame whereby the second cover sheet is hinged to the frame to form a flap covering the frame which can be flexed away from the frame to insert a card thereunder and into the frame opening;

(d) release liner means covering the adhesive on the second edge segment of the frame covered by said second cover sheet to protect the adhesive until assembly of the frame in the cover sheets.

2. An insert holder according to claim 1, wherein said first and second plastic sheets are separate and the outer perimeter of the adhesive frame is substantially co-extensive with the perimeter of said first and second plastic sheets.

3. An insert holder according to claim 1, wherein said release liner means comprises a first, U-shaped segment for being applied over the adhesive covering the second edge segment of the frame and a second, straight segment for being applied co-extensive with the fourth side of the same one of the first and second plastic sheets.

4. An insert holder according to claim 1, wherein said frame includes first and second openings for receiving respective cards.

5. An insert holder according to claim 4, wherein the surrounding non-transparent area of said first cover is opaque.

6. An insert holder according to claim 1, wherein the surrounding non-transparent area of said first cover is printed to provide an opaque decorative border.

7. An insert holder according to claim 1, 2, 3, 4 or 5 and including a magnetic data strip applied to one of the cover sheets.

8. A method of forming an insert holder of the type characterized by being adapted to receive and protect an object such as a card bearing a photograph or permit for display to an intermediate assembly configuration, and comprising the steps of:

(a) providing first and second plastic cover sheets for forming front and back surfaces of the insert holder;

(b) providing a frame having adhesive on opposing first and second surfaces for being adhesively positioned between said first and second plastic sheets for securing said first and second sheets together in to form the holder, said frame defining at least one opening for receiving a card therein;

(c) securing the frame by one of its first or second surfaces to one of the cover sheets;

(d) securing said second cover sheet to the other of the front or back surfaces of the frame along a first edge segment of the frame and leaving the remainder of the cover sheet unattached to a second edge segment of the frame whereby the second cover sheet is hinged to the frame to form a flap covering the frame which can be flexed away from the frame to insert a card thereunder and into the frame opening.

9. A method according to claim 8, and including the steps of inserting the card into the frame, and securing the cover sheet and frame along the second edge segment together after the card is inserted.

10. A method according to claim 8, and including the step of providing a release liner covering and protecting the adhesive along the second edge segment until after the card has been inserted into the frame and attachment of the second cover sheet and frame along the second edge segment is desired.

11. A method according to claim 8, 9, or 10 and including the step of providing a magnetic data strip applied to one of the cover sheets.

* * * * *